US012584304B2

(12) United States Patent
Keyes

(10) Patent No.: US 12,584,304 B2
(45) Date of Patent: Mar. 24, 2026

(54) SEWER SYSTEM OVERFLOW PREVENTION DEVICE

(71) Applicant: Renee Keyes, Irving, NY (US)

(72) Inventor: Renee Keyes, Irving, NY (US)

( * ) Notice: Subject to any disclaimer, the term of this patent is extended or adjusted under 35 U.S.C. 154(b) by 94 days.

(21) Appl. No.: 18/824,161

(22) Filed: Sep. 4, 2024

(65) Prior Publication Data

US 2025/0075487 A1 Mar. 6, 2025

Related U.S. Application Data

(60) Provisional application No. 63/580,485, filed on Sep. 5, 2023.

(51) Int. Cl.
*E03F 3/02* (2006.01)

(52) U.S. Cl.
CPC ..... *E03F 3/02* (2013.01)

(58) Field of Classification Search
CPC ..... E03F 3/02; E03F 3/04; E03F 3/043; E03F 5/106; E02B 11/005
See application file for complete search history.

(56) References Cited

U.S. PATENT DOCUMENTS 901,582 A * 10/1908 Austin ..... E02B 11/005 114/20.2
1,607,072 A 11/1926 Gremel
2,704,875 A 3/1955 Kingston
2,834,365 A 5/1958 Pair
4,102,135 A * 7/1978 Auriemma ..... E02B 11/005 405/43
4,134,268 A * 1/1979 Elmore ..... E02B 11/005 405/43
5,161,911 A * 11/1992 Regan ..... E03F 5/107 405/36
5,890,837 A * 4/1999 Wells ..... E03F 1/00 405/36
6,318,395 B1 * 11/2001 Anderson ..... E03F 5/107 210/170.08
6,749,367 B1 * 6/2004 Terry, III ..... E03F 1/002 405/48
9,631,356 B2 4/2017 Nesbitt
9,689,131 B2 * 6/2017 Taomoto ..... E02D 17/20
9,689,732 B1 * 6/2017 Montestruque ..... G01F 1/20
11,944,045 B2 * 4/2024 Gallegos ..... A01G 25/06
2008/0226393 A1 * 9/2008 Leun ..... A01G 25/06 405/43

(Continued)

*Primary Examiner* — Benjamin F Fiorello
(74) *Attorney, Agent, or Firm* — Brennan, Manna & Diamond, LLC

(57) ABSTRACT

A sewer system overflow prevention device is disclosed. The device features a semi-cylindrical bar with an inner concave surface and an outer convex surface, extending between two ends. A plurality of customizable slits, ranging from 3 mm to 10 mm in width, are transversely oriented along the bar, enabling water to pass while filtering debris. Under normal flow conditions, the slits permit water therethrough to enter a sewer system. During heavy rainfall, some of the water passes through the slits and excess water passes along the bar to surface runoff management systems or overflow channels, preventing sewer overflows. The device is made from corrosion-resistant materials and includes apertures for secure attachment to existing or new sewer systems.

20 Claims, 4 Drawing Sheets

(56) References Cited

U.S. PATENT DOCUMENTS

| | | | | |
|---|---|---|---|---|
| 2010/0119305 | A1* | 5/2010 | Rosinbaum | E02B 11/005 405/43 |
| 2014/0324406 | A1* | 10/2014 | Nesbitt | E03F 3/02 703/9 |
| 2015/0230416 | A1* | 8/2015 | Lo | A01G 9/02 47/79 |
| 2017/0145678 | A1* | 5/2017 | Moran | B01D 21/0051 |
| 2022/0120073 | A1* | 4/2022 | Meincke | E03F 5/04 |

* cited by examiner

SEWER SYSTEM OVERFLOW PREVENTION DEVICE

CROSS-REFERENCE TO RELATED APPLICATION

The present application claims priority to, and the benefit of, U.S. Provisional Application No. 63/580,485, which was filed on Sep. 5, 2023, and is incorporated herein by reference in its entirety.

FIELD OF THE INVENTION

The present invention generally relates to the field of water drainage devices. More specifically, the present invention relates to a novel device for improving combined sewer systems. The device includes a semi-cylindrical plastic mold with slits disposed (i.e., spaced) therein to enable water to pass therethrough. Under normal flow conditions, the slits permit water to enter the sewer system. During heavy rainfall, the device directs excess water to surface runoff management systems or overflow channels, preventing sewer overflows. Accordingly, this disclosure makes specific reference thereto. Nonetheless, it is to be appreciated that aspects of the present invention are also equally applicable to other like applications, devices, and methods of manufacture.

BACKGROUND

By way of background, a combined sewer system is a wastewater management system that combines sewage from homes and businesses. Combined sewer overflow occurs via use of combined sewer systems where a mixture of untreated or partially treated sewage and stormwater overflows into nearby rivers, lakes, or oceans through designated overflow points. Such systems often face significant challenges, particularly during periods of heavy rainfall. One of the most pressing issues is the overflow of sewage into natural water supplies, which can have detrimental environmental and public health impacts.

Combined sewer systems also collect various forms of debris, including women's hygiene products, plastics, and other solid waste. When these items are flushed into the sewer system, they can cause blockages and exacerbate overflow issues. The presence of such debris in the overflow water further contaminates the natural water bodies, contributing to environmental pollution and making water treatment more challenging. The overflow of untreated sewage and polluted stormwater not only affects water quality but also impacts the surrounding ecosystem. Plants exposed to sewage-contaminated water can suffer from stunted growth due to the presence of harmful chemicals and pathogens. Existing sewer management systems are not effective and there is a critical need for an innovative solution to improve the management of combined sewer systems.

Therefore, there exists a long-felt need in the art for a multipurpose sewer management device that controls the amount of rainwater that enters the sewer system. There is also a long-felt need in the art for an innovative sewer management device that filters out debris, prevents blockages, and reduces the number of pollutants in the sewage systems. Additionally, there is a long-felt need in the art for a special device for combined sewer systems that mitigates the adverse effects of sewer overflows on plant growth and local ecosystems. Moreover, there is a long-felt need in the art for a uniquely designed device that prevents overflows associated with heavy rains and debris from mixing with a sewage system. Further, there is a long-felt need in the art for a device that filters out excess water and debris from a sewage system. Finally, there is a long-felt need in the art for a uniquely designed plastic mold device with slits that enables water to go to a sewage system when there is no excess water and prevents overflows during excess rain and storm.

The subject matter disclosed and claimed herein, in one embodiment thereof, comprises a sewer system overflow prevention device. The device features a semi-cylindrical plastic mold elongated bar that extends between a first end and an opposite (i.e., opposing) second end, the semi-cylindrical bar includes an inner concave surface and an outer convex surface. A plurality of slits of same or different dimensions are disposed (i.e., spaced) along the semi-cylindrical bar, each slit extends across longitudinal edges of the semi-cylindrical bar and orients transversely to the length of the semi-cylindrical bar. Each slit is adapted to enable water to pass therethrough to a sewer system and the device passes the excess water to a water body to prevent overflow in the sewer system.

In this manner, the sewer system overflow prevention device of the present invention accomplishes all of the foregoing objectives and provides users with a novel device that is designed to manage excess rainwater by enabling it to bypass the sewer system during heavy rainfall, thereby preventing sewer overflows. By regulating the water flow into the sewer system, the device enables the sewer system to operate within its capacity, even during extreme weather conditions. The slits in the semi-cylindrical bar are designed to filter out debris such as women's hygiene products, plastics, and other solid waste, preventing these materials from entering the sewer system and causing blockages. The device can be used as an aftermarket product with existing combined sewer systems or integrated into new sewer system installations, offering flexibility in application. The slits can be customized to meet specific user requirements, enabling the device to be tailored to different sewer system configurations and local environmental conditions.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a sewer system overflow prevention device. The device features a semi-cylindrical bar that extends between a first end and an opposite (i.e., opposing) second end, the semi-cylindrical bar has a uniform width between the ends and includes an inner concave surface and an outer convex surface. A plurality of slits are disposed (i.e., spaced) in the semi-cylindrical bar, each slit extends across longitudinal edges of the semi-cylindrical bar and orients transversely to the length of the semi-cylindrical bar. Each slit is adapted to enable water to pass therethrough to a sewer system. Each slit has a width in the range from about 3 mm to about 10 mm.

In yet another embodiment, a plurality of apertures are disposed (i.e., spaced) along at least one longitudinal edge of the semi-cylindrical bar. Each aperture is configured to receive an anchor bolt or screw for securing the device to the sides of a combined sewer system drain.

In another embodiment, a sewer system overflow prevention device is disclosed. The sewer system overflow prevention device includes a semi-cylindrical bar, a plurality of slits, the slits are positioned at predetermined distances along the length of the semi-cylindrical bar. The slits are adapted to enable water to pass therethrough to a sewer system, and during periods of heavy rainfall, most of the rainwater passes along the semi-cylindrical bar to surface runoff management systems or overflow channels, and a limited amount of water is passed through the slits to the sewer system.

In another aspect, the device is made of a corrosion-resistant and durable material selected from the group consisting of plastic, steel, and metal.

In yet another aspect, the semi-cylindrical bar is positioned at an entry point of a combined sewer system drain, the inner concave surface faces upward to receive water from external sources, such that during excessive rainfall, the majority of the water passes along the bar to a distal end to bypasses the sewer system and is dispensed into a natural water body or an engineered solution such as a retention pond, drainage ditch, or stormwater management facility.

In yet another embodiment, a sewer system overflow prevention device for managing water flow in combined sewer systems is disclosed. The device includes a semi-cylindrical bar extending between a first end and an opposite (i.e., opposing) second end, the semi-cylindrical bar having a uniform width between the ends and comprising an inner concave surface and an outer convex surface. A plurality of slits are disposed (i.e., spaced) in the semi-cylindrical bar wherein the slits are configured to manage water flow such that under normal water flow conditions, the slits enable water to pass therethrough to a sewer system beneath and during periods of heavy rainfall, the slits enable some of the rainwater to bypass the sewer system by passing the water through the bar to the second end and directing some of the water to surface runoff management systems or overflow channels, thereby preventing sewer overflow.

Numerous benefits and advantages of this invention will become apparent to those skilled in the art to which it pertains upon reading and understanding of the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
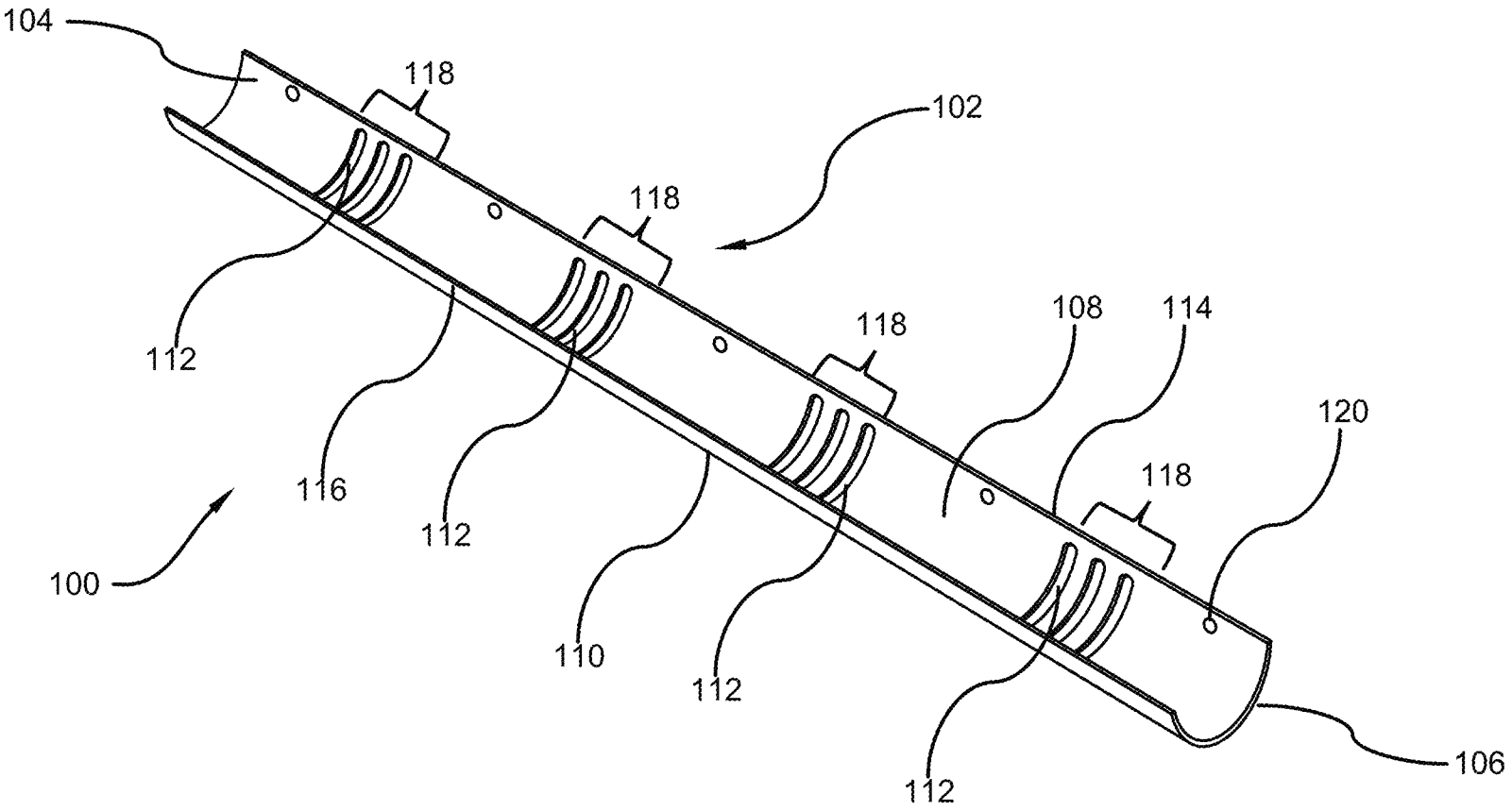
FIG. 1 illustrates a perspective view of sewer system overflow prevention device of the present invention in accordance with the disclosed structure.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long-felt need in the art for a multipurpose sewer management device that controls the amount of rainwater that enters the sewer system. There is also a long-felt need in the art for an innovative sewer management device that filters out debris, prevents blockages, and reduces the number of pollutants in the sewage systems. Additionally, there is a long-felt need in the art for a special device for combined sewer systems that mitigates the adverse effects of sewer overflows on plant growth and local ecosystems. Moreover, there is a long-felt need in the art for a uniquely designed device that prevents overflows associated with heavy rains and debris from mixing with a sewage system. Further, there is a long-felt need in the art for a device that filters out excess water and debris from a sewage system. Finally, there is a long-felt need in the art for a uniquely designed plastic mold device with slits that enables water to go to a sewage system when there is no excess water and prevents overflows during excess rain and storm.

The present invention, in one exemplary embodiment, is a sewer system overflow prevention device for managing water flow in combined sewer systems. The device includes a semi-cylindrical bar extending between a first end and an opposite (i.e., opposing) second end, the semi-cylindrical bar having a uniform width between the ends and comprising an inner concave surface and an outer convex surface. A plurality of slits are disposed (i.e., spaced) in the semi-cylindrical bar wherein the slits are configured to manage water flow such that under normal water flow conditions, the slits enable water to pass therethrough to a sewer system beneath and during periods of heavy rainfall, the slits enable some of the rainwater to bypass the sewer system by passing some of the water along the bar to the second end and directing the water to surface runoff management systems or overflow channels.

Reference will now be made in detail to the present preferred embodiments of the invention, examples of which are illustrated in the accompanying drawings. Wherever possible, the same reference numerals are used in the drawings and the description to refer to the same or like parts.

Referring initially to the drawings, FIG. 1 illustrates a perspective view of sewer system overflow prevention device of the present invention in accordance with the disclosed structure. The sewer system overflow prevention device 100 is designed to enhance the efficiency and functionality of combined sewer systems, particularly in urban areas where heavy rainfall can lead to sewer overflows. The sewer system management device 100 can be used as an aftermarket product with existing combined sewer systems and can also be integrated into new combined sewer systems. More specifically, the sewer system overflow prevention device 100 includes a semi-cylindrical bar or channel 102 extending between a first end 104 and an opposite (i.e., opposing) second end 106. The semi-cylindrical bar or channel 102 has a uniform width between the ends 104, 106 and has an inner concave surface 108 and an outer convex surface 110.

A plurality of slits 112 are disposed (i.e., spaced) in the semi-cylindrical bar or channel 102 wherein the shape and position of the slits 112 can be customized to meet requirements of users. Each slit of the plurality of slits 112 extends between the longitudinal edges 114, 116 of the semi-cylindrical bar or channel 102 and is oriented transversely to the length of the semi-cylindrical bar or channel 102. Each slit can have a width in the range from about 3 mm to about 10 mm, thereby enabling water to pass therethrough but prohibiting or deterring debris to pass through. In another embodiment, the width of the slits can range from about 5 mm to about 8 mm. The sewer system overflow prevention device 100 is preferably made of corrosion-resistant and durable material including, but not limited to, plastic, steel, metal, and more.

In the preferred embodiment, the slits 112 are disposed (i.e., spaced) in different sets 118 which are positioned at spaced apart distances along the length of the semi-cylindrical bar or channel 102. In one exemplary embodiment, each set 118 of three slits 112 is spaced along the length of the semi-cylindrical bar or channel 102. Under normal conditions, when water flow is slow or normal, the slits 112 in the semi-cylindrical mold or bar or channel 102 enable all, or nearly all, of the water to pass through to a sewer system. During periods of heavy rainfall, some of the rainwater passes directly over the slits 112. The slits 112 enable a metered amount of water to mix with the sewer system and thus, prevents or protects the sewer system from a sudden influx of rainwater, which can lead to overflows. It is to be appreciated that during periods of heavy rainfall, some of rainfall runoff remains in the semi-cylindrical bar or channel 102 and does not pass through to the sewer system.

For securing the sewer system management device 100, the device 100 includes a plurality of apertures 120 disposed (i.e., spaced) therein and preferably along at least one longitudinal edge of the device 100. The apertures 120 are configured to receive anchor bolts or screws to secure the device to the sides of the combined sewer system drain and the like. The anchoring hardware can depend on the material of the sewer infrastructure.

Figure 2:
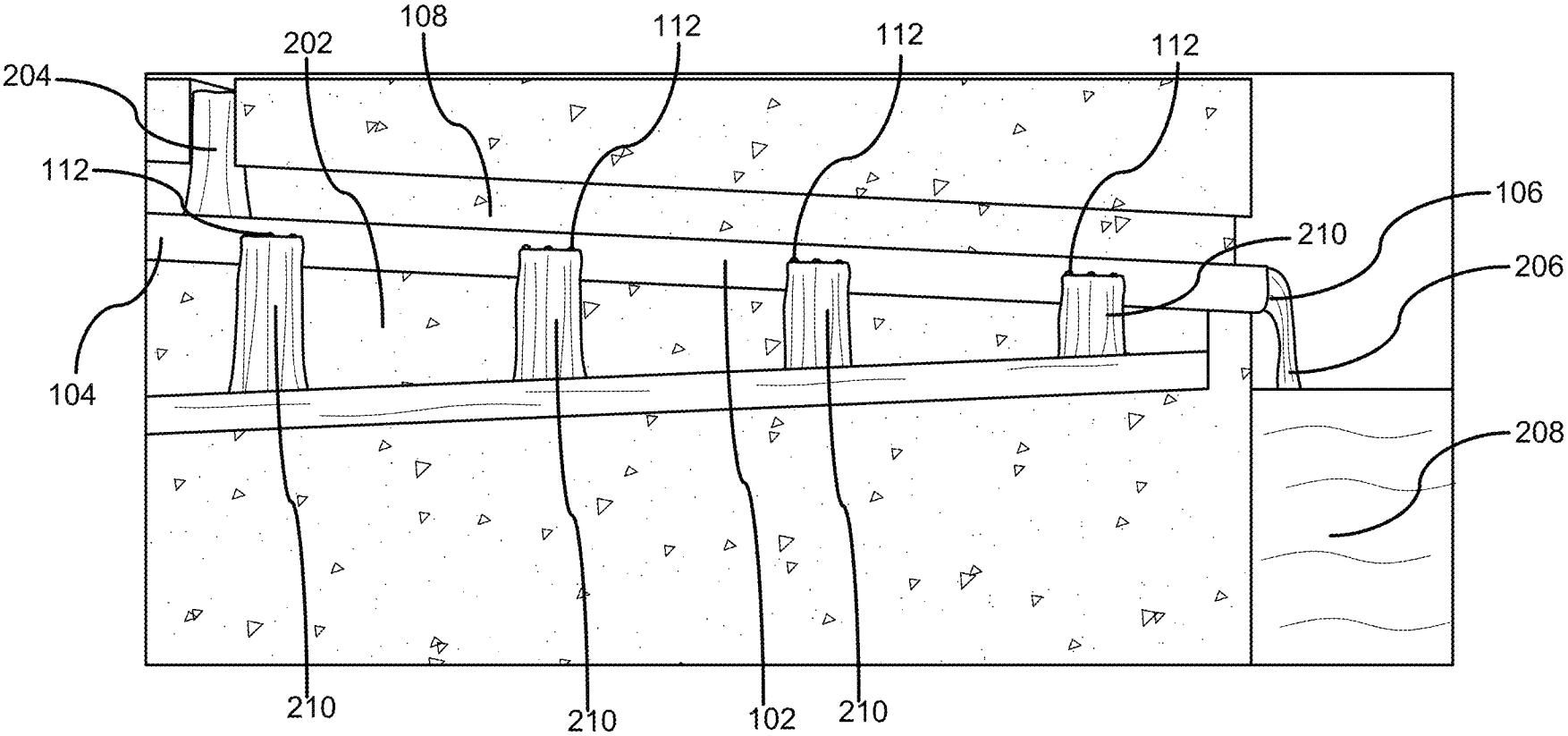
FIG. 2 illustrates a side perspective view of the sewer system overflow prevention device of the present invention being installed in a combined sewer system in accordance with one embodiment of the present invention.

FIG. 2 illustrates a side perspective view of the sewer system overflow prevention device of the present invention being installed in a combined sewer system in accordance with one embodiment of the present invention. As illustrated, the device 100 is secured in the combined sewer system drain 202 along the length of the drain 202. Preferably, the first end 104 of the bar or channel 102 is positioned at the entry point of the drain 202 for receiving the water. The device 100 is positioned such that the concave surface 108 receives excess water 204 from the external sources which can be rainwater, sanitary drain water, and more. When water 204 is received in the drain 202 and flow of the water 204 is more such as during rainfall (as illustrated), the excess water 206 passes through (i.e., along) 100 and can be mixed with natural water bodies like rivers or lakes, or engineered solutions such as retention ponds, drainage ditches, or stormwater management facilities 208.

The water portion 210 passed through the slits 112 is passed to the sewage system and does not contain any debris or unhygienic products. The water portion 210 can be easily handled by the treatment plants and prevents overflow of the sewage systems and treatment plants. During heavy rainfall, some of the water bypasses the sewer system via the device 100 and is directed to surface runoff management systems or overflow channels or water bodies 208 to prevent overloading the sewer infrastructure.

Figure 3:
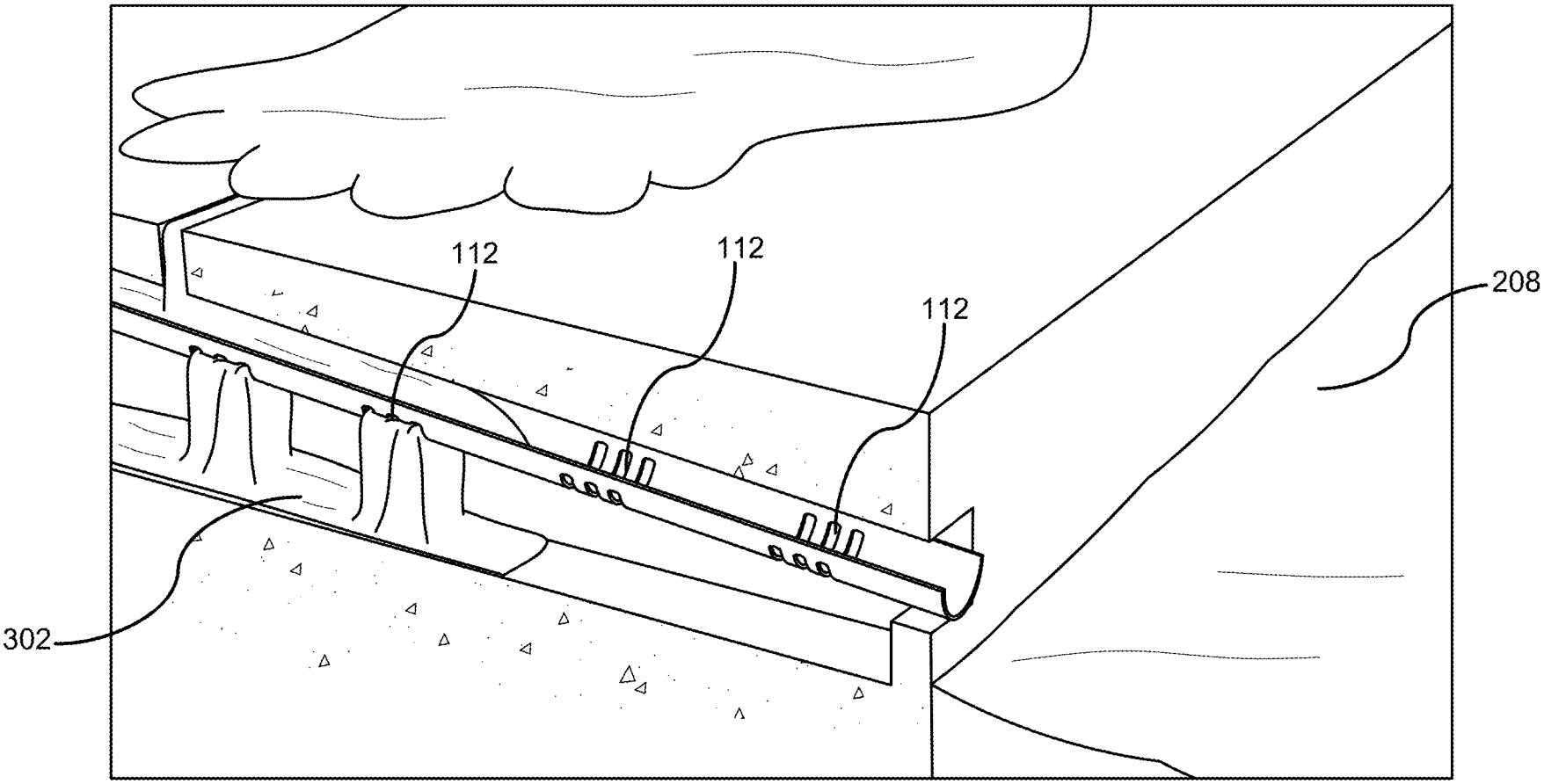
FIG. 3 illustrates a perspective view of flow of water through (i.e., along) in normal water conditions in accordance with the disclosed structure.

FIG. 3 illustrates a perspective view of flow of water through normal water conditions in accordance with the disclosed structure. As illustrated, in normal water flow, when the water 302 enters the device 100, the slits 112 enable water 302 to pass therethrough to pass to the sewer system. The water 302 does not pass to the runoff management systems or overflow channels or water bodies 208.

Figure 4:
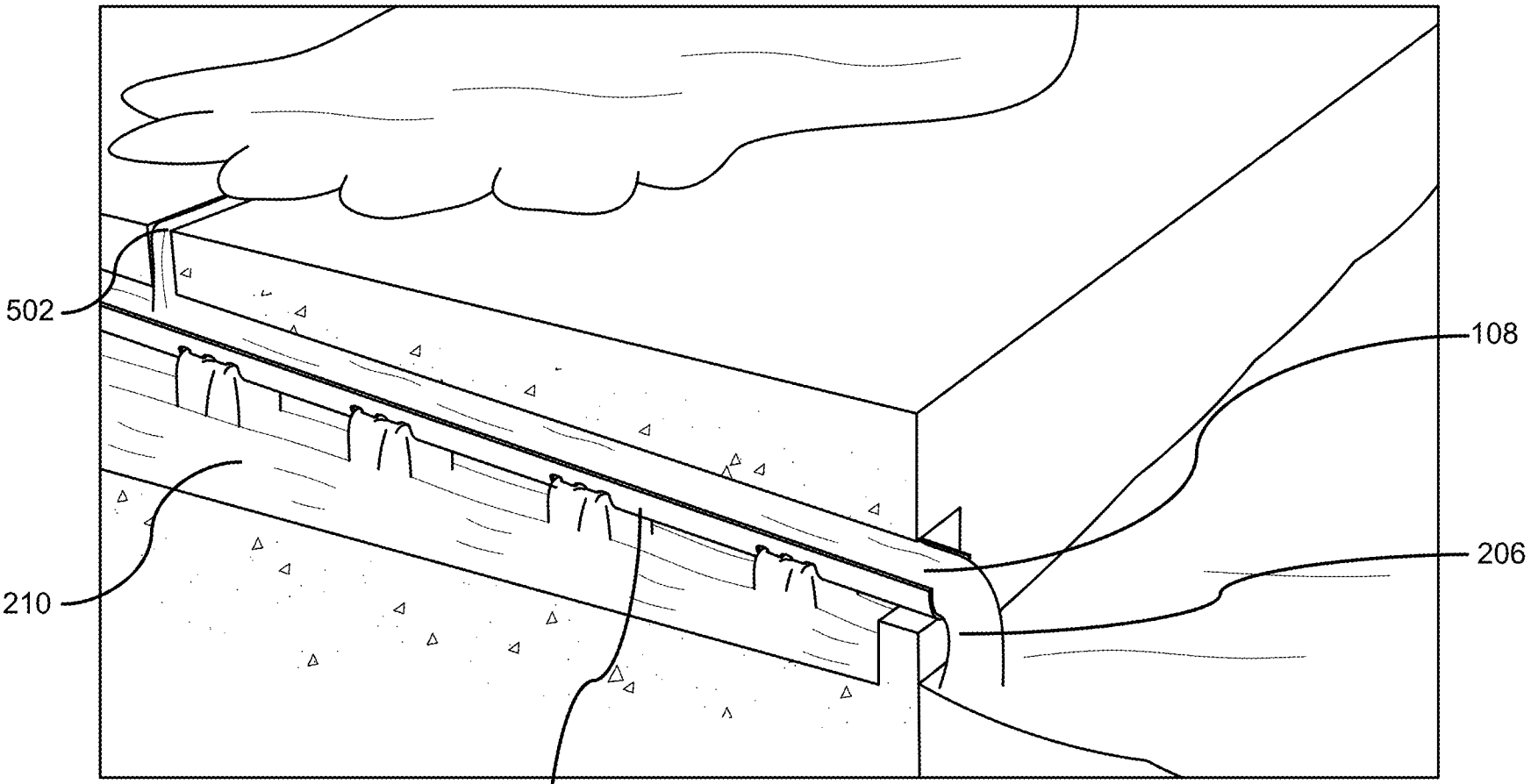
FIG. 4 illustrates another perspective view showing flow of water through the sewer system overflow prevention device during excessive rainfall in accordance with the disclosed structure.

FIG. 4 illustrates another perspective view showing flow of water through and along the sewer system overflow prevention device during excessive rainfall in accordance with the disclosed structure. As illustrated, the excessive water 206 passes along the bar or channel 102 and is dispensed into a water body 208. The water 210 passes through the slits 112 and is transmitted to the sewer system and public water treatment systems. The device 100 can receive water from storm drains 202, sanitary drains, and other existing drains embedded in conventional combined sewer systems.

It will be apparent to a person skilled in the art that the sewer system overflow prevention device 100 can be positioned in any direction and orientation to enable water to pass through the bar or channel 102 and to pass through the slits 112. The concavity of the bar or channel 102 can be designed based on the water flow expected to be received by the device 100 during rainfall season. The sewer system overflow prevention device 100 can be designed in different lengths to meet requirements of different users.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "sewer system overflow prevention device", "sewer system management device", "combined sewer system overflow prevention and rainwater management device", and "device" are interchangeable and refer to the combined sewer system overflow prevention and rainwater management device 100 of the present invention.

Notwithstanding the foregoing, the combined sewer system overflow prevention and rainwater management device 100 of the present invention can be of any suitable size and configuration as is known in the art without affecting the overall concept of the invention, provided that it accomplishes the above-stated objectives. One of ordinary skill in the art will appreciate that the combined sewer system overflow prevention and rainwater management device 100 as shown in the FIGS. are for illustrative purposes only, and that many other sizes and shapes of the combined sewer system overflow prevention and rainwater management device 100 are well within the scope of the present disclosure. Although the dimensions of the combined sewer system overflow prevention and rainwater management device 100 are important design parameters for user convenience, the combined sewer system overflow prevention and rainwater management device 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A sewer system overflow prevention device comprising:

a semi-cylindrical bar extending between a first end and an opposing second end;

a plurality of slits;

a first longitudinal edge; and a second longitudinal edge;

wherein said semi-cylindrical bar having a uniform width between said first end and said second end;

wherein said semi-cylindrical bar having an inner concave surface and an outer convex surface;

wherein said plurality of slits are spaced along said semi-cylindrical bar; and further wherein said plurality of slits oriented transversely to said first longitudinal edge and said second longitudinal edge.

2. The sewer system overflow prevention device of claim 1, wherein each one of said plurality of slits having a width from 3 mm to 10 mm.

3. The sewer system overflow prevention device of claim 1, wherein each one of said plurality of slits each having a width from 5 mm to 8 mm.

4. The sewer system overflow prevention device of claim 1, wherein said semi-cylindrical bar having a material selected from the group consisting of a plastic, a steel, and a metal.

5. The sewer system overflow prevention device of claim 1, wherein said plurality of slits are formed in sets of slits.

6. The sewer system overflow prevention device of claim 5, wherein each set of said sets of slits spaced apart from another said set of slits along a length of said semi-cylindrical bar.

7. The sewer system overflow prevention device of claim 6, wherein each set of said sets of slits having three slits.

8. The sewer system overflow prevention device of claim 1, wherein said semi-cylindrical bar having a plurality of spaced apart apertures along at least one of said first longitudinal edge and said second longitudinal edge for mounting said semi-cylindrical bar to a sewer system drain.

9. A sewer system overflow prevention device comprising:

a semi-cylindrical bar extending between a first end and an opposing second end;

a plurality of slits;

a first longitudinal edge; and a second longitudinal edge;

wherein said semi-cylindrical bar having a uniform width between said first end and said second end;

wherein said semi-cylindrical bar having an inner concave surface and an outer convex surface;

wherein said plurality of slits are spaced along said semi-cylindrical bar;

wherein said plurality of slits oriented transversely to said first longitudinal edge and said second longitudinal edge;

wherein said semi-cylindrical bar having a material selected from the group consisting of a plastic, a steel, and a metal;

wherein each one of said plurality of slits each having a width from 3 mm to 10 mm; and further wherein said plurality of slits are formed in sets of slits.

10. The sewer system overflow prevention device of claim 9, wherein each one of said plurality of slits having a width from 5 mm to 8 mm.

11. The sewer system overflow prevention device of claim 9, wherein each set of said sets of slits spaced apart from another set of said sets of slits along a length of said semi-cylindrical bar.

12. The sewer system overflow prevention device of claim 9, wherein said semi-cylindrical bar having a plurality of spaced apart apertures along at least one of said first longitudinal edge and said second longitudinal edge for mounting said semi-cylindrical bar to a sewer system drain.

13. A sewer system overflow prevention device comprising:

a semi-cylindrical bar extending between a first end and an opposing second end;

a plurality of slits;

a first longitudinal edge; and a second longitudinal edge;

wherein said semi-cylindrical bar having a uniform width between said first end and said second end;

wherein said plurality of slits are spaced along said semi-cylindrical bar;

wherein said plurality of slits oriented transversely to said first longitudinal edge and said second longitudinal edge; and further wherein said plurality of slits are formed in sets of slits.

14. The sewer system overflow prevention device of claim 13, wherein each one of said plurality of slits having a width from 3 mm to 10 mm.

15. The sewer system overflow prevention device of claim 13, wherein each one of said plurality of slits each having a width from 5 mm to 8 mm.

16. The sewer system overflow prevention device of claim 13, wherein said semi-cylindrical bar having a material selected from the group consisting of a plastic, a steel, and a metal.

17. The sewer system overflow prevention device of claim 16, wherein said semi-cylindrical bar having an inner concave surface and an outer convex surface.

18. The sewer system overflow prevention device of claim 17, wherein each set of said sets of slits spaced apart from another set of said sets of slits along a length of said semi-cylindrical bar.

19. The sewer system overflow prevention device of claim 18, wherein each set of said sets of slits having three slits.

20. The sewer system overflow prevention device of claim 19, wherein said semi-cylindrical bar having a plurality of spaced apart apertures along at least one of said first longitudinal edge and said second longitudinal edge for mounting said semi-cylindrical bar to a sewer system drain.

* * * * *